United States Patent [19]

Stillwell

[11] 4,273,167

[45] Jun. 16, 1981

[54] TRASH BAG HOLDER

[76] Inventor: David J. Stillwell, 300 Washington Ave., #201D, Elyria, Ohio 44035

[21] Appl. No.: 71,038

[22] Filed: Aug. 30, 1979

[51] Int. Cl.[3] ..... B65B 1/04

[52] U.S. Cl. ..... 141/314; 141/391; 248/97

[58] Field of Search ..... 248/97, 99, 100; 141/313, 314, 315, 316, 317, 390, 391, 10, 114

[56] References Cited

U.S. PATENT DOCUMENTS

| | | | |
|---|---|---|---|
| 504,787 | 9/1893 | Kountz | 248/97 |
| 1,542,164 | 6/1925 | Nelson et al. | 248/97 |
| 1,858,793 | 5/1932 | Reynolds | 248/97 |

*Primary Examiner*—Houston S. Bell, Jr.
*Attorney, Agent, or Firm*—Baldwin, Egan, Walling & Fetzer

[57] ABSTRACT

A trash bag holding stand that may be manually assembled without the use of tools to support a pliable bag (such as a plastic bag) in open fillable position.

The stand includes a rectangular frame with its corners formed of right angle pipe elbows having sockets disposed at right angles to each other. The sides of the frame are elongated members such as pipes which are telescoped into the respective sockets of the elbows to form the frame. The elbows also have leg-receiving sockets into which legs are telescoped to support the frame. Upstanding pins are disposed on the top surface of the elbows for detachably receiving the plastic bag. The stand may be provided with a cloth bag for receiving the plastic bag to protect it from breaking. A funnel may be provided to facilitate flow of waste material into the plastic bag.

10 Claims, 12 Drawing Figures

TRASH BAG HOLDER

BACKGROUND OF THE INVENTION

This invention relates to bag-supporting structures and more particularly to a manually assemblable trash bag holding stand that supports a pliable bag in open fillable position to receive limp waste material.

As is well known, garbage, leaves, grass clippings and other like limp waste material is usually collected in a disposable pliable bag, such as a plastic bag, and discarded in such bag. Heretofore, the collection of garbage and waste material in plastic bags has been relatively difficult, and transfer or removal of such filled bags has been an onerous and often messy procedure. For example, it is most difficult to hold the mouth of large plastic bags open while they are being filled. If a stand is provided for the bag, it is difficult to remove the waste-filled bag from the stand.

Various support stands have been proposed to hold pliable bags in open position, but have not found general acceptance because of their relatively expensive structure, difficulty of assembly, and difficulty in removing the waste-filled bag from the stand. There has long been a need for an inexpensive, rigid, trash bag holding stand for holding plastic bags in open material-receiving position that is very easy to assemble and disassemble without tools and which permits quick and easy removal of the waste-filled bag from the stand.

The primary object of the invention is to provide an easily assemblable stand for holding the mouth of large plastic bags open when they are being filled.

Another object of the invention is to provide a bag-holding stand of the above type that will be rigid when set up for use and easy to disassemble for storage.

A further object of the invention is to provide a structure of the above type that may be easily assembled and disassembled without tools.

A further object of the invention is to provide a trash bag holding stand of the above type permitting quick and easy removal of the waste-filled bag from the stand.

A further object of the invention is to provide a bag-holding stand of the above type that is simple in construction, inexpensive to manufacture, and highly effective in operation. Briefly, the foregoing objects are accomplished by the provision of a manually assemblable stand for removably supporting an associated pliable (plastic) bag of predetermined size including a closed four-cornered rectangular frame, and legs depending downwardly and outwardly from the four corners of the frame. Each corner of the frame is formed of a hollow tubular right-angle corner pipe elbow forming rod-receiving sockets disposed at right angles to each other. The sides of the frame are formed of elongated members such as, for example, pipe sections telescoped into the respective sockets of the corner pipe elbows to form the rectangular frame. Each corner pipe elbow has a leg-receiving socket, and the legs are telescoped into such leg-receiving sockets of the respective elbows. Each of the corner pipe elbows has an upstanding pin secured to the top surface thereof for detachably receiving a top edge portion of the associated pliable bag to hold such bag on the frame. Preferably, the pins project upwardly and outwardly from the corner pipe elbows. A funnel is provided having its lower portion receivable just within and so disposed on the frame to guide the flow of material into the associated pliable bag when such bag is secured to the frame. A cloth bag may be secured to the frame and extend downwardly therefrom, whereby the associated pliable bag is placed within the cloth bag and secured to the frame thereby protecting the associated pliable bag from breaking.

Other objects and advantages of the invention will be apparent from the following description taken in conjunction with the drawings wherein:

BRIEF DESCRIPTION OF THE DRAWINGS

FIG. 9 is a perspective view similar to FIG. 1, but showing a funnel added to the top of the stand;

In the drawings, like numbers and letters are used to identify like and similar parts through the several views.

DESCRIPTION OF THE PREFERRED EMBODIMENTS

Figure 1:
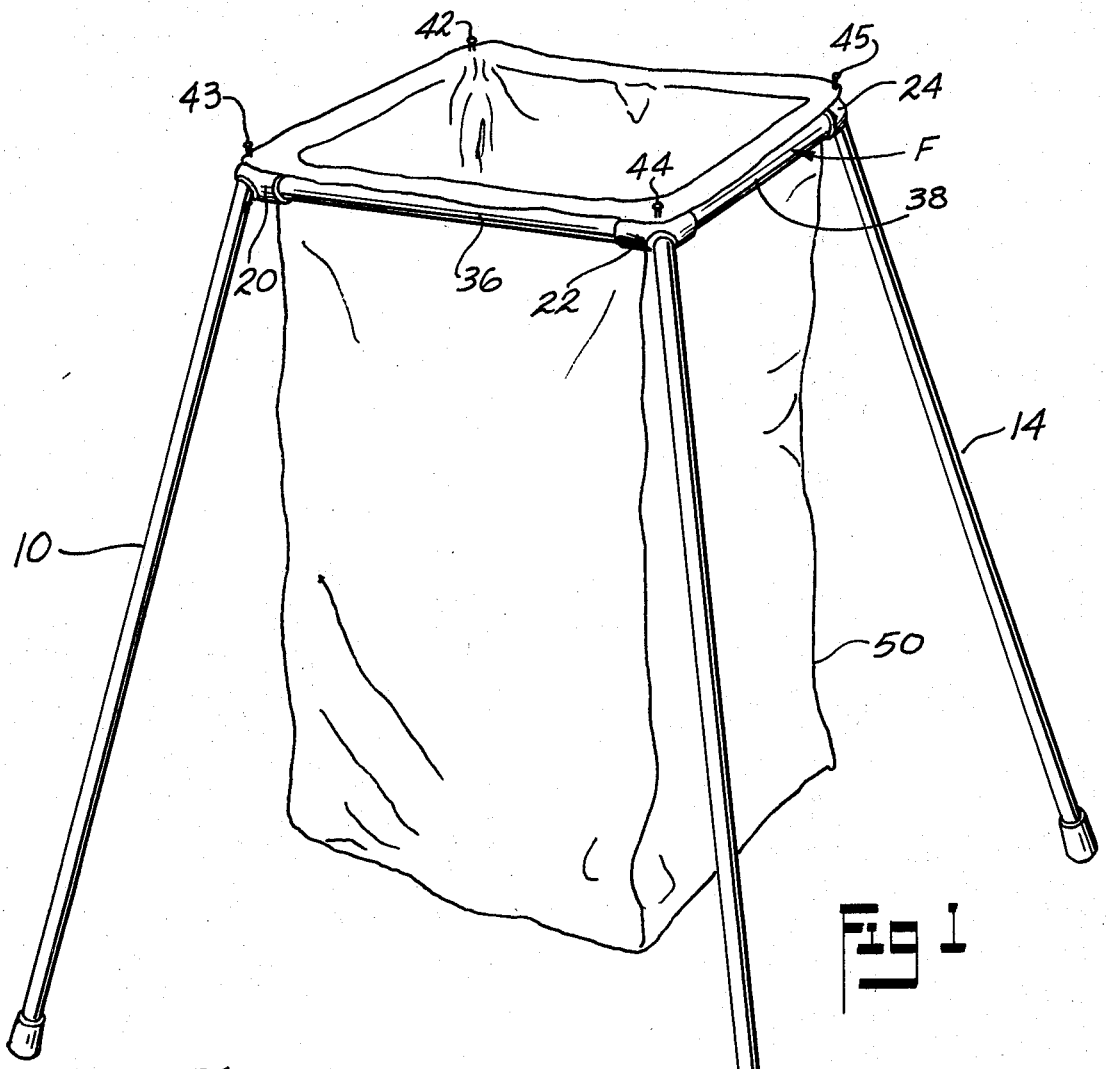
FIG. 1 is a perspective view of a trash bag holding stand constructed in accordance with the invention.

Referring first to FIG. 1, there is shown a manually assemblable trash bag holding stand, constructed in accordance with the invention, and including a closed rectangular (preferably square) four-cornered frame, generally designated as F, having (preferably four) legs 10, 12, 14 (and a fourth leg not shown), extending downwardly and outwardly therefrom.

Figure 2:
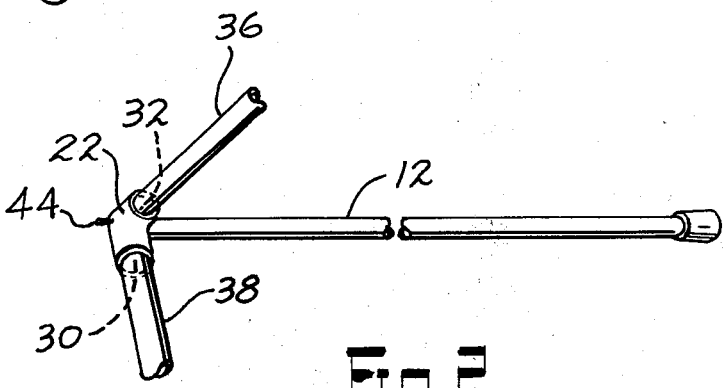
FIG. 2 is a broken, portional, perspective view of the forward-most corner section of the stand shown in FIG. 1.

The corners of the frame F are formed of hollow tubular right-angle corner pipe elbows 20, 22, 24 (and a fourth elbow not shown) each having rod-receiving sockets 30, 32 (FIG. 2) disposed at right angles to each other. Since all elbows are the same, only one will be described in detail. The sides of the frame are formed of elongated members (FIG. 1) such as, for example, pipe sections 36, 38 (and two other pipe sections not shown) telescoped into the respective aforedescribed sockets of the corner pipe elbows to form the rectangular frame F. Each corner pipe elbow has a recessed leg-receiving socket 40 (FIGS. 3, 4 and 5) and the legs are telescoped into such leg-receiving sockets in the respective elbows. The corner pipe elbows are provided with upstanding pins 42, 43, 44 and 45 (FIG. 1) secured to the top surface thereof for detachably receiving a top edge portion of an associated pliable (plastic) bag 50 to hold such bag on the frame F. Preferably, the pins project upwardly and outwardly from the corner pipe elbows.

Figure 3:
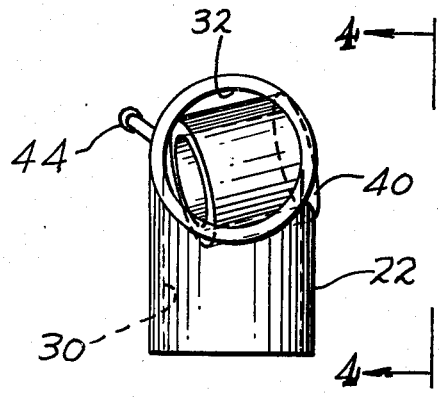
FIG. 3 is a side elevational view of the corner pipe elbow shown in FIG. 2.
Figure 4:
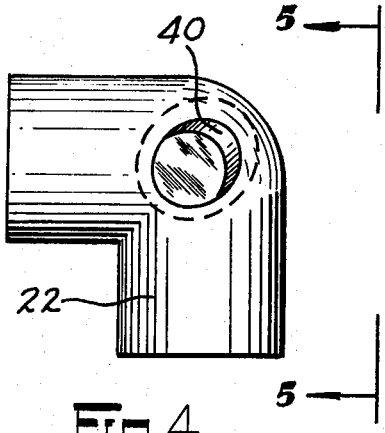
FIG. 4 is a view taken along the line 4—4 of FIG. 3.
Figure 5:
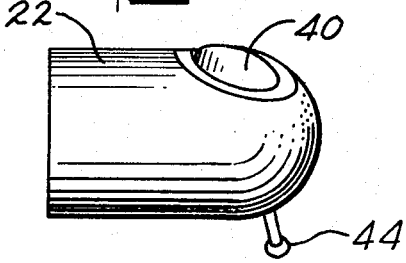
FIG. 5 is a view taken along the line 5—5 of FIG. 4.

In the elbow 22 shown in FIGS. 3, 4 and 5, it is to be noted that the leg-receiving socket 40 is recessed within the elbow housing and is referred to herein as the "recessed socket" structure.

Figure 6:
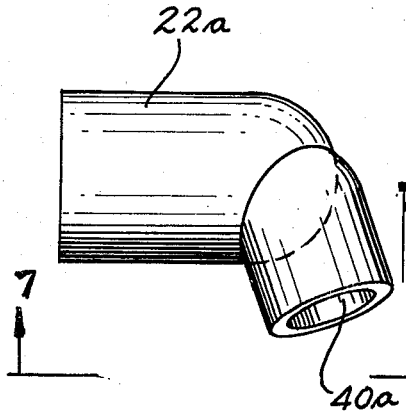
FIG. 6 is a top plan view showing a modification of the corner pipe elbow shown in FIGS. 3, 4 and 5.
Figure 7:
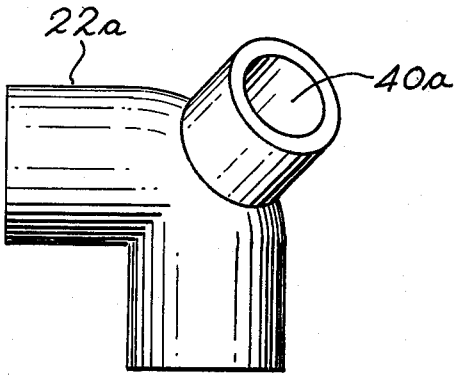
FIG. 7 is a view taken along the line 7—7 of FIG. 6.
Figure 8:
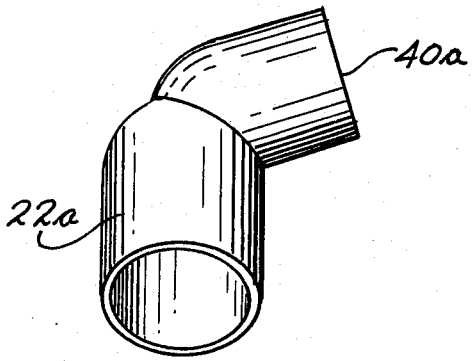
FIG. 8 is a view similar to FIG. 6, but with the elbow rotated ninety degrees counterclockwise.
Figure 3:
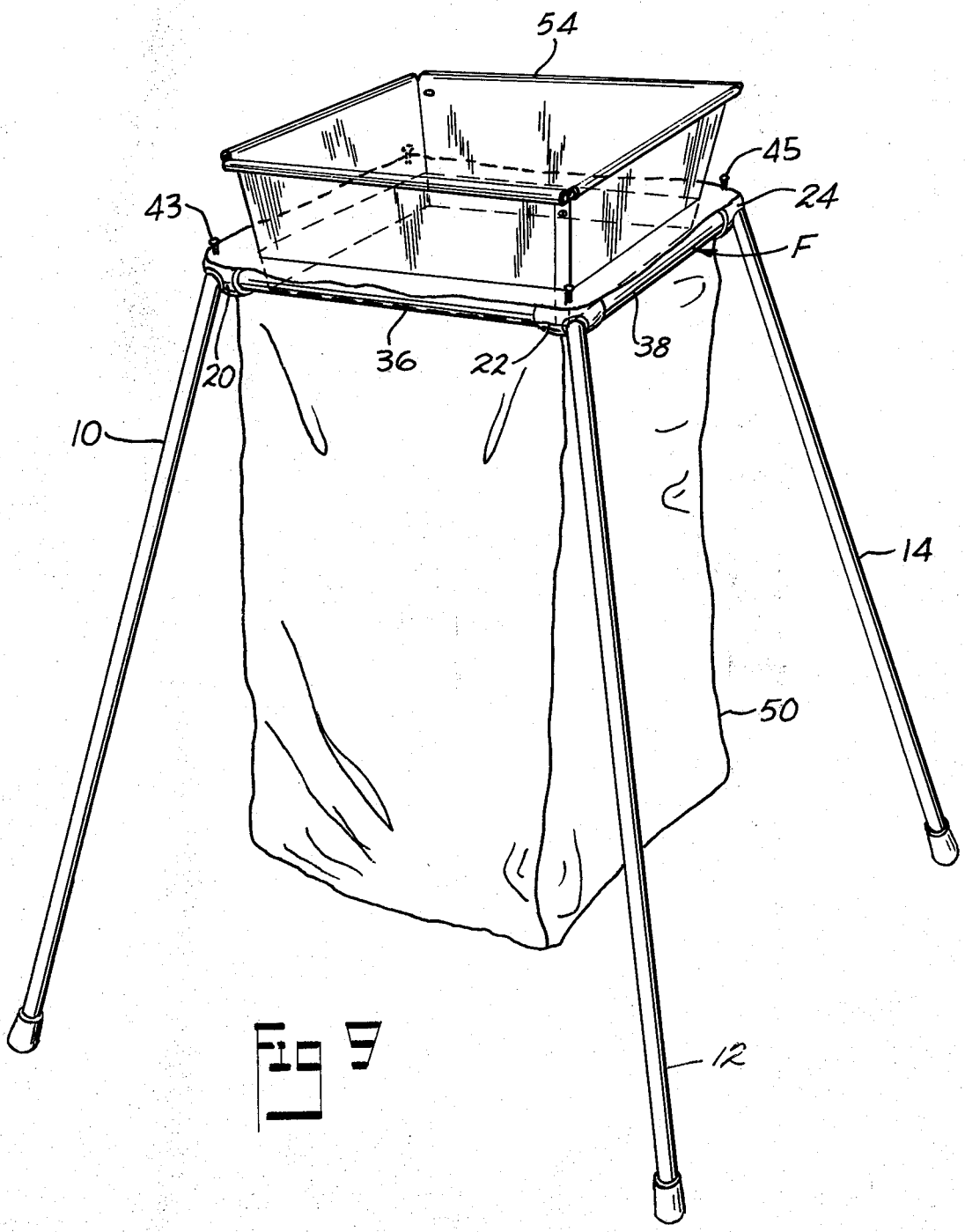

FIGS. 6, 7 and 8 show a modification of such leg-receiving socket. Specifically, the elbow 22a has a leg-receiving socket 40a disposed on the exterior of such elbow, such socket extending downwardly and outwardly of the elbow so that the legs extend downwardly and outwardly of the frame F. It will be noted that the recessed socket of elbow 22 also extends downwardly and outwardly. This structure provides stability and also substantial spacing between the lower portions of the legs of the assembled stand, thus permitting easy removal of a filled (bulging) bag from the stand.

It is to be particularly noted that the invention provides a bag holding stand having only twelve parts—four elbows, four pipes sections and four legs—all of which are very easy to assemble (without tools) simply by telescoping the legs and pipe sections into their respective sockets in the elbows. When the stand is erected, the plastic bag 50 is simply placed down within the frame, as shown in FIG. 1, and the top edge portion of the bag is folded outwardly and over the frame F and hung on the pins 42, 43, 44, 45 as shown.

Figure 10:
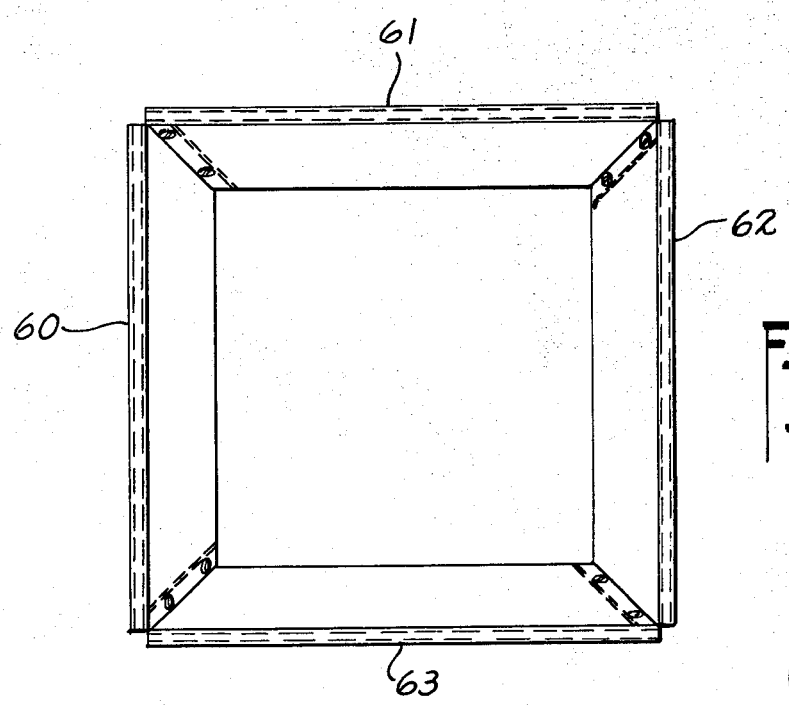
FIG. 10 is a top plan view of the funnel shown in FIG. 9.
Figure 12:
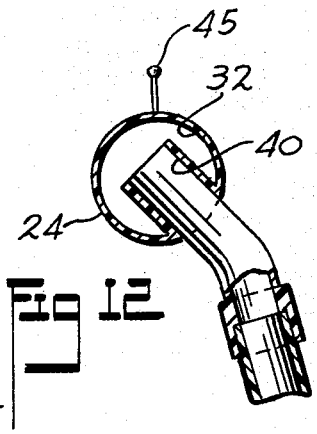
FIG. 12 is an enlarged view of the upper right leg joint shown in FIG. 11.

A suitable funnel 54 may be placed on the frame F, as shown in FIG. 9, to facilitate the flow of waste material in the bag 50. The funnel may be formed of four trapazoidal sections 60, 61, 62, 63 (FIG. 10) bolted or otherwise secured together. In the preferred form, the funnel 54 extends only a slight distance below the frame F and into the bag 50, such that the lower portion of the funnel is received just within the frame to provide a maximum mouth section of the funnel to minimize impeding the flow of waste material into the bag.

Figure 11:
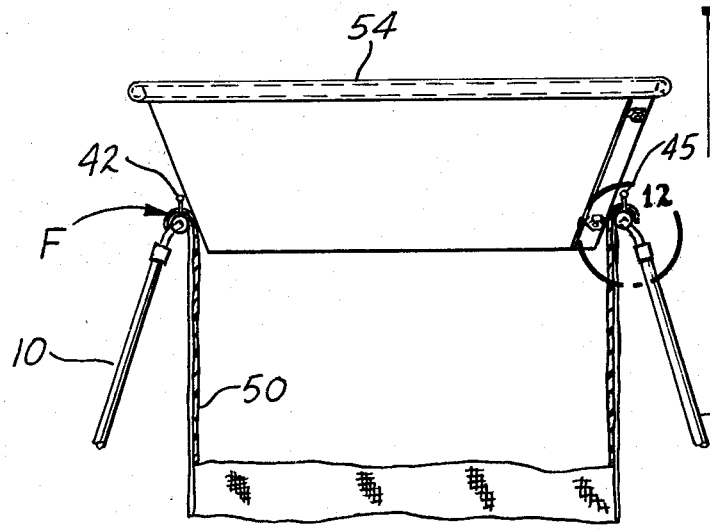
FIG. 11 is a portional front elevational view, partly in section, of the top portion of the stand shown in FIG. 9.

To substantially reduce the chances of tearing or rupturing the plastic bag 50, a cloth bag 66 (FIG. 11) may be first placed on the frame F (and extend downwardly therewithin), after which the plastic bag 50 is placed within the cloth bag 66 and hung on the frame as aforedescribed.

The terms and expressions which have been used are used as terms of description, and not of limitation, and there is no intention in the use of such terms and expressions of excluding any equivalents or any of the features shown, or described, or portions thereof, and it is recognized that various modifications are possible within the scope of the invention claimed.

What is claimed is:

1. A manually assemblable stand for removably supporting an associated pliable bag of predetermined size comprising; a closed four-cornered rectangular frame, and each of the four corners having a leg depending downwardly therefrom to provide said frame with four depending legs, said frame having each corner thereof formed of a hollow tubular right-angle corner pipe elbow forming rod-receiving sockets disposed at right angles to each other, said frame also having the sides thereof formed of elongated members telescoped into the respective sockets of said corner pipe elbows to form the frame, said legs being secured to said corner pipe elbows, the associated bag being removably supported on said closed four-cornered rectangular frame.

2. The structure of claim 1 wherein each of said corner pipe elbows has a leg-receiving socket, and said legs are telescoped into said leg-receiving sockets.

3. The structure of claim 2 wherein said leg-receiving sockets are formed interiorly of the corner pipe elbows to form interior sockets for receiving said legs.

4. The structure of claim 2 wherein said leg-receiving sockets are disposed on the exterior of the corner pipe elbows and extend downwardly therefrom forming exterior sockets for receiving said legs.

5. The structure of claim 2 wherein said leg-receiving sockets are directed downwardly and outwardly from the corner pipe elbows whereby the legs extend downwardly and outwardly providing stability for the stand and providing easy removal of a filled bag from the stand.

6. The structure of claim 1 wherein each of said corner pipe elbows has an upstanding pin secured to the top surface thereof for detachably receiving a top edge portion of the associated pliable bag to hold such bag on the frame.

7. The structure of claim 6 wherein said pins project upwardly and outwardly from the corner pipe elbows.

8. The structure of claim 6 and further including a funnel having its lower portion receivable just within the frame to guide the flow of material into the associated pliable bag when such bag is secured to the frame.

9. The structure of claim 1 and further including a cloth bag secured to the frame and extending downwardly therefrom, whereby the associated pliable bag is placed within the cloth bag and secured to the frame thereby protecting the associated pliable bag from rupturing.

10. A manually assemblable stand for removably supporting an associated pliable bag of predetermined size comprising; a closed four-cornered rectangular frame, legs depending downwardly and outwardly from the four corners of the frame, said frame having each corner thereof formed of a hollow tubular right-angle corner pipe elbow forming rod-receiving sockets disposed at right angles to each other, said frame also having the sides thereof formed of elongated members telescoped into the respective sockets of said corner pipe elbows to form the frame, each of said corner pipe elbows having a leg-receiving socket, said legs being telescoped into said leg-receiving sockets, each of said corner pipe elbows having an upstanding pin secured to the top surface thereof for detachably receiving a top edge portion of the associated pliable bag to hold such bag on the frame, said pins projecting upwardly and outwardly from the corner pipe elbows, a funnel having its lower portion receivable just within and so disposed the frame to guide the flow of material into the associated pliable bag when such bag is secured to the frame, and a cloth bag secured to said frame and extending downwardly therefrom, whereby the associated pliable bag is placed within the cloth bag and secured to the frame thereby protecting the associated pliable bag from rupturing.

* * * * *